US009647368B2

(12) United States Patent
Davies et al.

(10) Patent No.: US 9,647,368 B2
(45) Date of Patent: May 9, 2017

(54) TERMINALS FOR ELECTRICAL CONNECTORS

(71) Applicant: IDEAL INDUSTRIES, INC., Sycamore, IL (US)

(72) Inventors: Brian Davies, Acton, MA (US); Charles York, Townsend, MA (US)

(73) Assignee: IDEAL Industries, Inc., Sycamore, IL (US)

( * ) Notice: Subject to any disclaimer, the term of this patent is extended or adjusted under 35 U.S.C. 154(b) by 12 days.

(21) Appl. No.: 14/493,120

(22) Filed: Sep. 22, 2014

(65) Prior Publication Data

US 2016/0087366 A1 Mar. 24, 2016

(51) Int. Cl.

| | |
|---|---|
| ***H01R 13/11*** | (2006.01) |
| *H01R 4/18* | (2006.01) |
| *H01R 12/58* | (2011.01) |

(52) U.S. Cl.

CPC ..... *H01R 13/114* (2013.01); *H01R 4/184* (2013.01); *H01R 12/58* (2013.01)

(58) Field of Classification Search

CPC ..... H01R 12/75; H01R 13/03; H01R 13/501; H01R 13/6272; H01R 13/6583; H01R 43/16; H01R 4/48; H01R 4/4818

See application file for complete search history.

(56) References Cited

U.S. PATENT DOCUMENTS 3,221,293 A 11/1965 Regan
3,414,868 A 12/1968 Howe
3,644,872 A 2/1972 Russo, Jr.
4,772,234 A * 9/1988 Cooper ..... H01R 13/11 439/398
5,145,422 A 9/1992 Fry
5,554,056 A * 9/1996 Henricus op ten Berg ..... H01R 13/112 439/851
5,681,190 A * 10/1997 Childs ..... H01R 13/11 439/842
5,683,267 A 11/1997 Ribbeck et al.
(Continued)

FOREIGN PATENT DOCUMENTS

WO 2013/012887 A2 1/2013

OTHER PUBLICATIONS

ISA/US, International Search Report and Written Opinion issued on PCT application No. US14/56829, date of mailing Mar. 31, 2015, 11 pages.

*Primary Examiner* — Truc Nguyen
(74) *Attorney, Agent, or Firm* — Greenberg Traurig, LLP

(57) ABSTRACT

A female terminal for an electrical connector may generally include a socket with an opening for receiving a male terminal, a first pair of contacts, a second pair of contacts, a pair of crimping members, and positioning tabs. The socket may be defined by a pair of opposing sidewalls, a top, and a bottom, at least in examples where the socket is generally rectangular. The first and second pairs of contacts may be disposed along the pair of opposing sidewalls, projecting at least partially into the socket configured to contact and exert substantially the same normal force on a male terminal that is inserted into the socket. The pair of crimping members can be utilized to secure a wire to the female terminal, and the positioning tabs may be utilized to secure the female terminal within the electrical connector.

14 Claims, 8 Drawing Sheets

(56) References Cited

U.S. PATENT DOCUMENTS

| | | | | |
|---|---|---|---|---|
| 6,102,754 | A * | 8/2000 | Capper | H01R 13/113 439/517 |
| 6,113,417 | A * | 9/2000 | Furutani | H01R 4/2466 439/397 |
| 6,193,567 | B1 | 2/2001 | Hsieh | |
| 6,394,858 | B1 * | 5/2002 | Geltsch | H01R 13/114 439/843 |
| 7,252,559 | B1 * | 8/2007 | Morello | H01R 4/185 439/843 |
| 7,300,319 | B2 * | 11/2007 | Lutsch | H01R 4/185 439/845 |
| 7,462,079 | B2 * | 12/2008 | Fabian | H01R 4/4818 439/438 |
| 7,927,127 | B1 * | 4/2011 | Glick | H01R 4/245 439/397 |
| 8,827,756 | B2 * | 9/2014 | Mueller | H01R 13/112 439/852 |
| 8,900,021 | B2 * | 12/2014 | Sulek | B23K 1/0008 439/884 |
| 2010/0206631 | A1 * | 8/2010 | Peters | H01R 4/62 174/77 R |
| 2012/0264340 | A1 * | 10/2012 | Mueller | H01R 13/112 439/861 |
| 2014/0242824 | A1 | 8/2014 | Karadimas et al. | |

* cited by examiner

TERMINALS FOR ELECTRICAL CONNECTORS

FIELD OF THE DISCLOSURE

The present disclosure relates generally to electrical connectors and, more particularly, to terminals for electrical connectors.

BACKGROUND OF RELATED ART

It is known that many electrical connectors employ pin and socket terminals. Typically a "male" terminal of a first electrical connector is inserted into a "female" terminal of a second electrical connector to interconnect different portions of a circuit or, in some cases, numerous circuits. One type of female terminal known in the art involves a generally-rectangular female socket disposed at a distal end for receiving a male terminal. Oftentimes the distal end of the female socket takes on the shape of an elongate member defined by a top wall, a bottom wall, and sidewalls that form a passageway for receiving the male terminal. Female terminals such as these are usually stamped and formed from sheet metal so that a slit may be incorporated into one or more of the walls that form the socket. The slits allow the walls of the socket to flex as the male terminal is inserted. Moreover, one type of male terminal known in the art involves a generally-rectangular pin that is capable of being inserted into the generally-rectangular socket of the female terminal.

One problem with conventional pin and socket terminals, however, is that they introduce a sizeable voltage drop. In essence, as electric current moves through the pin and socket terminals of the electrical connectors, supplied energy is dissipated and throughput is reduced. This dissipation of energy is undesirable in virtually all circumstances.

Recent designs have attempted to improve on other aspects of pin and socket terminals rather than voltage drops. For instance, electrical connectors are oftentimes connected or disconnected while electrical power is present at the terminals. When such "hot" electrical connectors are just a short distance from one another, electrical arcs are generated from current passing through the terminals. In this state, electrons "jump" across the gap from one connector to the other. Electrical arcs are undesirable because they can cause the terminals to corrode, as well as cause build-up of non-conductive and/or poorly conducting residues. The corrosion and/or build-up interfere with the quality of the electrical contact between the terminals in subsequent connections. Nonetheless, one recent design attempts to minimize the impact of such electrical arcs by supplementing two primary contacts on a female terminal with two "sacrificial" or "arc-discharging" contacts such that there is one contact on all four sides of the socket. Yet this design generally fails to alleviate the impact of the voltage drop across the electrical connectors because the ability of the two sacrificial contacts to conduct is quickly diminished, and these two additional points of contact do not meaningfully aid the conductivity of the interconnected electrical connectors.

Thus, a long-felt need exists for terminals that considerably reduce the voltage drop experienced across a pair of interconnected electrical connectors.

DETAILED DESCRIPTION

Figure 1:
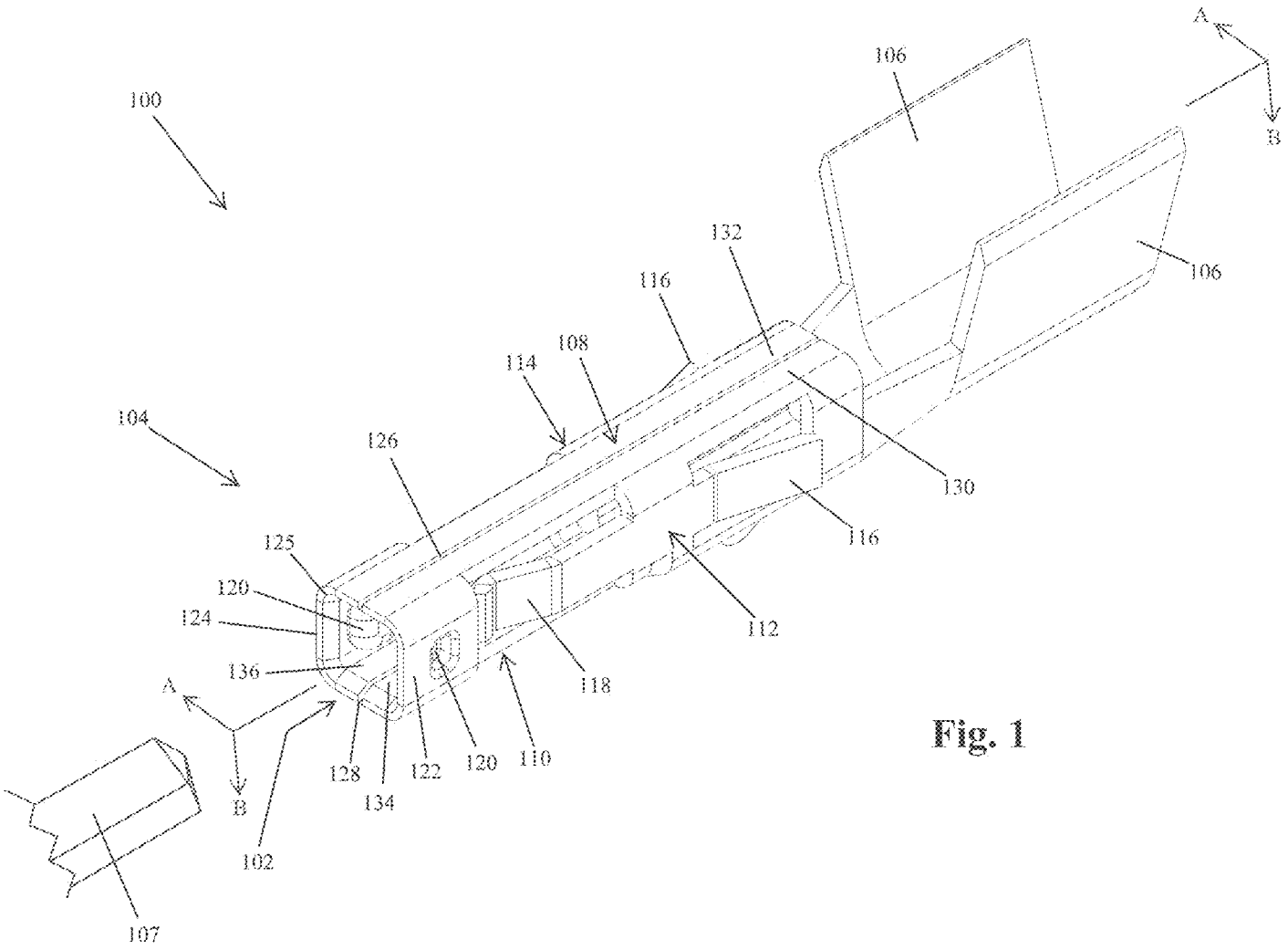
FIG. 1 is a perspective view of an example terminal for an electrical connector.

To provide a female terminal that considerably reduces the voltage drop across a pair of interconnected electrical connectors, examples of terminals are disclosed below that generally include a first pair of contacts, a second pair of contacts, a pair of crimping members, positioning tabs, and a socket with an opening for receiving a male terminal. The socket may be defined by a left sidewall, a right sidewall, a top wall, and a bottom wall. The socket is in many cases generally rectangular, as the left sidewall typically opposes the right sidewall, and the top wall typically opposes the bottom wall. The first and second pairs of contacts may be disposed along, and in some cases formed from, the left and right sidewalls. The first pair of contacts may be associated with a first contact surface and a second contact surface, while the second pair of contacts may be associated with a third contact surface and a fourth contact surface. In some instances, these four contact surfaces may be configured to apply substantially the same normal force to a male terminal that can be inserted into the socket. Likewise, in some instances, these four contact surfaces may have substantially the same surface areas.

As will be appreciated, the second pair of contacts may, in some examples, be disposed closer to the opening of the socket than the first pair of contacts. The second pair of contacts may be disposed along portions of the left and right sidewalls that extend between the top and bottom walls, adjacent to the socket. Moreover, the first and second pair of contacts may be resilient and configured to be in an interference relationship with a male terminal that can be inserted into the socket. In other words, at least some parts of the first and second pair of contacts may project into the socket such that when a male contact is inserted into the socket, the male contact displaces the first and second pairs of contacts slightly away from the socket. Such a configuration is one way to maintain the four respective contact surfaces against a male contact inserted into the socket.

To generate the normal forces applied by the first and second pair of contacts, various methods may be employed. For instance, in one example the first pair of contacts are cantilevered and resilient. Thus when a male contact displaces the first pair of contacts outwards from the socket, the first pair of contacts exert normal forces on the male contact. As a further example, the top and bottom walls may include slits that extend along some portion of the top and bottom walls to the opening of the socket. The slits allow left and right portions of the top and bottom walls to flex away from one another when the male contact is inserted into the socket. In turn, the second pair of contacts, which in some examples are connected to the portions of the terminal that are moving away from one another, exert a normal force onto the male contact.

Furthermore, crimping members may be disposed opposite a distal end of the terminal where the socket and first and second pair of contacts are disposed. The crimping members are typically utilized to secure the insulation of one or more wires and/or the conductors of the one or more wires to the terminal. Put another way, the crimping members prevent the wires from backing out of the terminal. In some cases, the terminal may have no crimping members or just one. In other examples, though, the terminal may have more than a pair of crimping members, such as one pair to secure the wire insulation and another pair to secure the internal conductors of the wire, for instance. Still further, other types of securing devices may be utilized, such as for example, push-in type terminal connectors, or other suitable structures. In addition, the positioning tabs may also be disposed along the left and right sidewalls of the terminal in some examples. The positioning tabs may be resilient and biased outwards in some examples. The positioning tabs may be compressed inwards when the terminal is inserted into a housing of the electrical connector. Once in place, the positioning tabs may snap into respective recesses within the housing of the electrical connector to secure the terminal within the housing.

The following description of example terminals is not intended to limit the scope of the disclosure to the precise form or forms detailed herein. Instead the following description is intended to be illustrative so that others may follow its teachings.

Referring now to FIG. 1, an example terminal 100 is shown for an electrical connector (such as example electrical connectors 308, 312, 360, 366, 406, 410, 450, 452 shown in FIGS. 5A, 5B, 6A, 6B, 7, and 8). In some examples, the example terminal 100 includes a socket 102 disposed at or along a distal end 104, as well as a pair of crimping members 106 opposite the distal end 104. The socket 102 is in one example generally rectangular in shape and is configured to receive a corresponding "male" terminal 107 as is commonly known in the art. Those having ordinary skill in the art will recognize that the socket 102 is not limited to a generally-rectangular shape and may take on other shapes (e.g., quadrilateral, circular, elliptical, triangular, pentagonal, hexagonal, etc.) depending on the shape of the male terminal 107 of another electrical connector that the socket 102 is intended to receive. Nonetheless, the example socket 102 shown in FIG. 1 is rectangular and is formed by a top wall 108, a bottom wall 110, a left sidewall 112, and a right sidewall 114.

In some cases, the example terminal 100 is stamped and formed from sheet metal, either in whole or in part. In one example, the crimping members 106 are secured to an electrical wire (FIG. 5A) or, more specifically, insulation of the electrical wire by deforming the crimping member 106 onto and/or around the electrical wire. In another example, the crimping members 106 may be secured to one or more internal conductors within the insulation of the electrical wire. The crimping members 106 help prevent the electrical wire and/or its internal conductor(s) from backing out of the terminal 100. In some examples, the terminal 100 may have more than one pair of crimping members 106, such as one that may be secured to the electrical wire's insulation and another that may be secured to internal conductors of the electrical wire, for instance. In some cases, the crimping members 106 may vary in size and shape depending on the size and shape of the object(s) that each respective pair of crimping members is intended to secure.

In still other examples, however, the terminal 100 may include other features in place of or in addition to the crimping members 106. For instance, the example terminal 100 may include at least one projection opposite the distal end for securing the terminal 100 to a conductor or printed wiring board by way of soldering or welding. In another example, the terminal 100 may include at least one projection opposite the distal end, where the projection forms a male electrical terminal that is receivable by a female electrical terminal. In still another example, the terminal 100 may include at least one insulation displacement terminal opposite the distal end. The insulation displacement terminal may secure the insulation or internal conductor of a wire. Yet further, the example terminal 100 may include at least one threaded compression terminal opposite the distal end in some cases. The threaded compression terminal may be utilized to secure the insulation or internal conductor of a wire. In another example, the terminal 100 may include at least one spring compression terminal opposite the distal end for securing the insulation or internal conductor of a wire.

To prevent the example terminal 100 from backing out of a housing of an electrical connector, the example terminal 100 may optionally include a pair of positioning tabs 116 that project outward from terminal 100, such as for example, from the left and right sidewalls 112, 114. In other examples, the terminal 100 contains no positioning tabs, one positioning tab, or more than two positioning tabs. The example positioning tabs 116 are resilient so as to flex inwards when the terminal 100 is inserted into the housing of the electrical connector. Once the terminal 100 is in place or nearly in place inside the housing of the electrical connector, the positioning tabs 116 may reach a pair of corresponding recesses, shoulders, or other openings into which the two positioning tabs 116 may snap. Once in place, the positioning tabs 116 substantially prevent the terminal 100 from backing out of the electrical connector, and furthermore, the positioning tabs 116 may further help prevent the terminal 100 from rotating within the housing of the electrical connector.

With continued reference to FIG. 1, the example terminal 100 also includes a first pair of contacts 118 and a second pair of contacts 120. In this example, the first and second pairs of contacts 118, 120 are disposed along the distal end 104 of the terminal 100 adjacent to and/or partially disposed within the socket 102 formed by the top wall 108, the bottom wall 110, the left sidewall 112, and a right sidewall 114. Thus at least some parts of the first and second pairs of contacts 118, 120 project into the socket 102. The first and second pairs of contacts 118, 120 are arranged to engage with the male terminal 107 that is inserted into the socket 102.

In some examples, the first and second pairs of contacts 118, 120 are formed in the left and right sidewalls 112, 114 of the terminal 100 using forming and stamping techniques known in the art. The first and second pairs of contacts 118, 120 may be said to be disposed about the socket 102. In one example the first pair of contacts 118 is formed at least in part by removing material from the left and right sidewalls 112, 114. The first pair of contacts 118 may also be cantilevered, resilient, and biased slightly inwards towards the socket 102 in some examples. In one example, the first pair of contacts 118 is designed to be in an interference relationship with the male contact 107 that can be received by the terminal 100. In other words, the first pair of contacts 118, or at least some part thereof, projects into the socket 102 of the terminal 100 so that when the male contact 107 is inserted into the socket 102, the first pair of contacts 118, or at least the part projecting into the socket 102, is forced outwards by the male contact 107. Due to the resiliency and inward bias of the first pair of contacts 118, however, the first pair of contacts 118 remain in physical and electrical contact with the male contact 107.

Hence, each of the first pair of contacts 118 applies a normal force to an outer surface of the male contact 107 when inserted. The normal force that is required from the first pair of contacts 118 may vary from one application to the next, but in one non-limiting example, the normal force applied by each of the first pair of contacts 118 is between 200 to 400 grams. In other examples, though, the normal force may be larger or smaller, in some cases considerably, than 200 to 400 grams. Moreover, several ways to increase or decrease the normal force involve modifying various aspects of the first pair of contacts 118, including without limitation material composition, thickness, radius of curvature, amount of interference, and the like.

The second pair of contacts 120 also applies normal forces to the male contact 107 when inserted within the socket 102. In the example terminal 100 shown in FIG. 1, each of the second pair of contacts 120 is disposed in portions 122, 124 of the left and right sidewalls 112, 114 that extend between the top and bottom walls 108, 110 at the distal end 104 of the terminal 100. Thus in this example, the second pair of contacts 120 are each disposed along the same walls as the first pair of contacts 120, but closer to an opening 125 of the socket 102 than the first pair of contacts 118. By utilizing four contacts, with two disposed along one wall and two disposed along an opposing wall of the socket 102, the voltage drop across the example terminal 100 is considerably reduced.

Furthermore, to cause the second pair of contacts 120 to be resilient and exert a normal force on the male contact 107 when inserted within the socket 102, the example socket 102 includes a pair of slits 126, 128 that extend longitudinally along the top and bottom walls 108, 110. In other examples, the slits 126, 128 may extend along a length of the top and bottom walls 108, 110. Yet in other example terminals, the slits 126, 128 may extend along only portions of the top and bottom walls 108, 110. The slits 126, 128 of the example terminal 100 allow a left portion 130 and a right portion 132 of the top wall 108, as well as a left portion 134 and a right portion 136 of the bottom wall 110, to flex transversely, away from one another, when the male contact 107 is inserted into the socket 102. Thus, similar to the first pair of contacts 118, the second pair of contacts 120 is configured in one example to be in an interference relationship with the male contact 107 when the male contact 107 is inserted into the socket 102.

While the example second pair of contacts 120 may be configured to exert a wide range of normal forces on the male contact 107, as those having ordinary skill in the art will appreciate, each of the second pair of contacts 120 in FIG. 1 may in some examples be configured to exert substantially the same normal force as each of the first pair of contacts 120 (i.e., 200 to 400 grams in the example identified above). By utilizing four contacts (i.e., "first" and "second" contacts associated with the first pair of contacts 118 and "third" and "fourth" contacts associated with the second pair of contacts 120), each of which exerts substantially the same normal force on the male contact 107 when inserted, the voltage drop across the example terminal 100 is considerably reduced. It should also be understood that in some examples all four contacts have the same current carrier. Nevertheless, various aspects of the example terminal 100 may be modified to vary the normal forces exerted by the second pair of contacts 120, including a length, a thickness, a width, and a material composition of the top and bottom walls 108, 110; an amount of interference; lengths of the slits 126, 128; and thickness of the sidewalls 112, 114, for instance.

Figure 2:
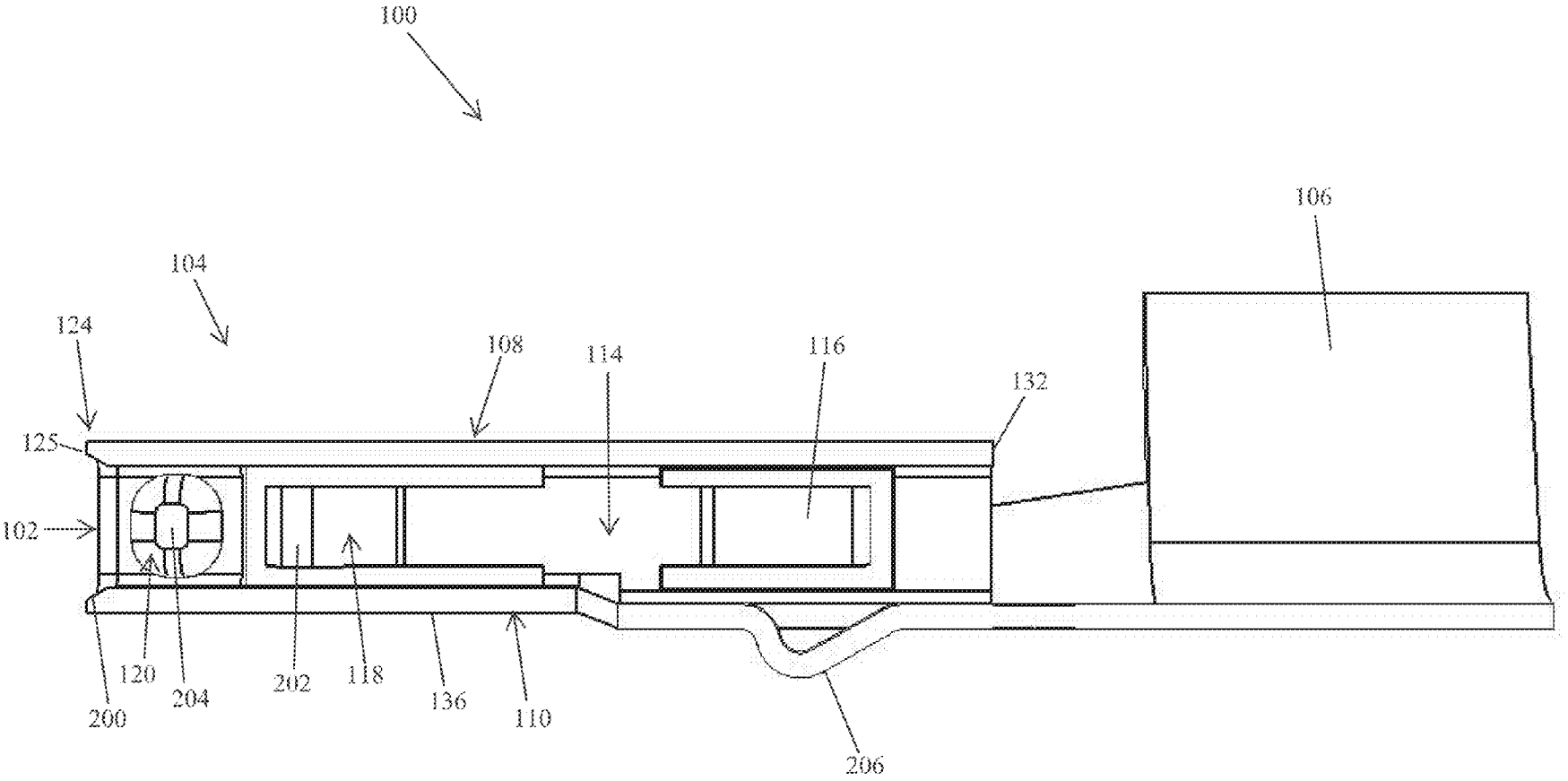
FIG. 2 is a cross-sectional side view of the example terminal of FIG. 1 taken across line A-A in FIG. 1.

Turning now to FIG. 2, the example terminal 100 is shown in cross section taken across line A-A in FIG. 1. Several features of the example terminal 100 can be seen more clearly in FIG. 2. For instance, the opening 125 of the example socket 102 of the example terminal 100 includes a tapered inlet 200 that promotes ingress as a male contact is inserted into the socket 102. Also shown more clearly in FIG. 2 is an example contact surface 202 of one of the first pair of contacts 118 as well as an example contact surface 204 of one of the second pair of contacts 120. In this example, the first and second pair of contacts 118, 120 are designed such that the respective contact surfaces 202, 204, as well as those not shown in FIG. 2, have substantially equal surface areas for contacting a male contact that is received by the socket 102. In one non-limiting example, the surface area of the contact surfaces 202, 204 is designed so that a load of between 200 and 400 grams at each of the four contact surfaces 202, 204 results in a force at each of the contact surfaces 202, 204 in the range of 200 to 400 grams. Of course, this is merely one example, and those having ordinary skill in the art will appreciate that the example terminal 100 may be designed such that the load, pressure, and/or contact surface areas associated with the first and second pairs of contacts 118, 120 differ considerably from the examples given above.

Still another feature shown more clearly in FIG. 2 is a locating feature 206 disposed near or along the bottom wall 110 of the example terminal 100. Contrary to the example positioning tabs 116 that help to prevent the terminal 100 from backing out of an electrical housing, the locating feature 206 helps locate the terminal within the electrical housing by preventing the terminal 100 from being inserted too far. For instance, in this example the locating feature 206 contacts a shoulder or some other structure within the electrical housing to limit fore/aft movement once properly located within the housing.

Figure 3:
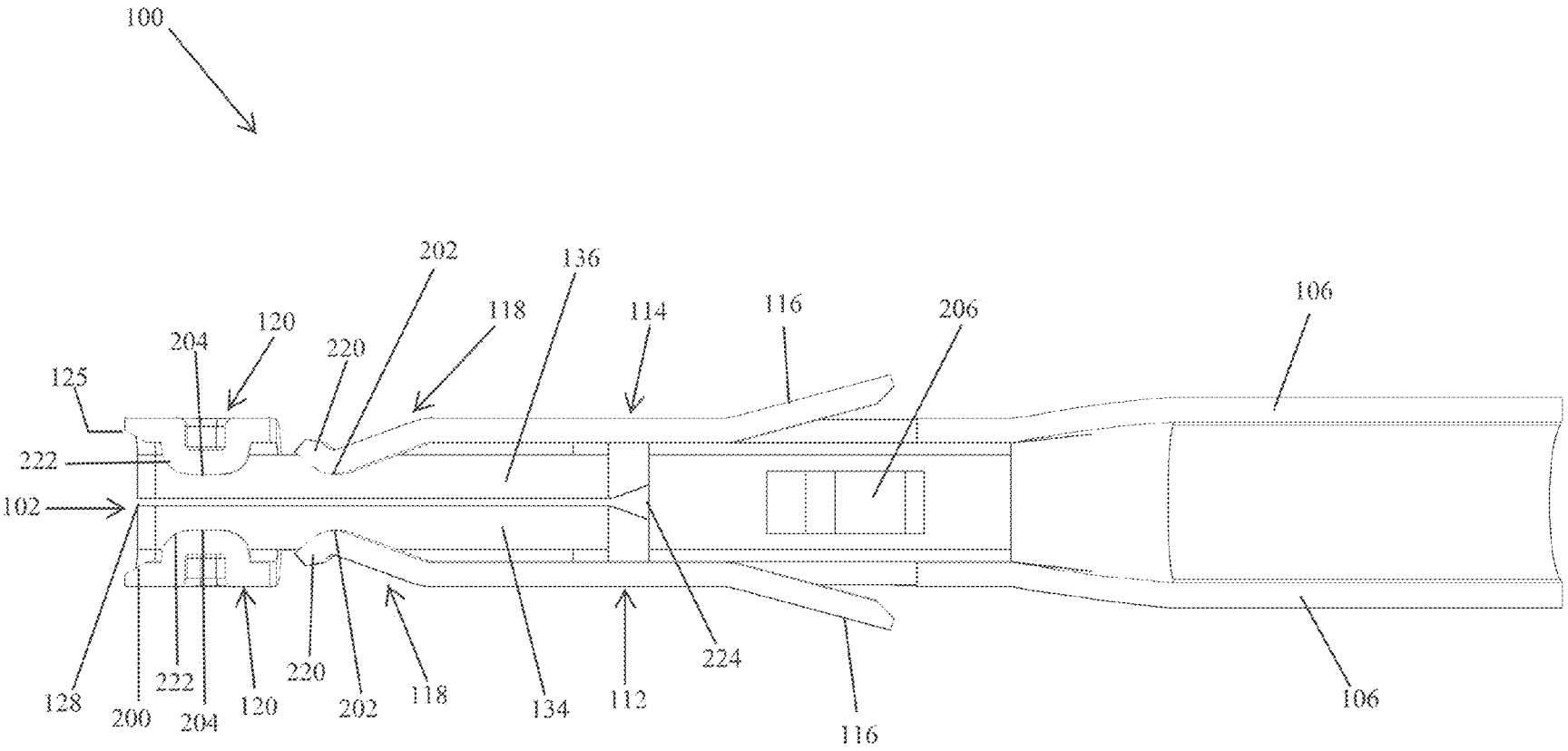
FIG. 3 is a cross-sectional side view of the example terminal of FIG. 1 taken across line B-B in FIG. 1.

With respect to FIG. 3, the example terminal 100 is shown in cross section taken across line B-B of FIG. 1. FIG. 3 shows more clearly the shapes of the example first and second pairs of contacts 118, 120, according to the present example of the terminal 100. In particular, the example first pair of contacts 118 have tips 220 that curve away from the socket 102. Configuring the tips 220 in this shape allows the male contact to force the first pair of contacts 118 outwards as it is inserted fully into the socket 102. Moreover, although the contact surfaces 202 of the first pair of contacts 118 are shown to be rounded from the top view of this example terminal 100, it should be understood that in other examples the contact surfaces 202 may have a different shape. For instance, in some examples the contact surfaces 202 may have a substantially flat surface that contacts a male terminal that is inserted into the socket 102.

Likewise, those having ordinary skill in the art will understand that the example second pair of contacts 120 is in no way limited to the shape shown in the example terminal 100 of FIG. 3. To that end, the present disclosure contemplates that in some examples the contact surfaces 204 of the second pair of contacts 120 may be slightly angled to account for the outward transverse movement of the second pair of contacts 120 as a male contact is inserted into the socket 102. If the contact surfaces 204 are parallel to one another, sides 222 of the contact surfaces 204 closer to the opening 125 of the socket 102 may physically separate from an inserted male contact because the second pair of contacts 120 are moved transversely outwards based on a pivot that is closer to point 224. This phenomenon is particularly true where the terminal 100 is designed to experience a fair amount of interference between a male contact and the second pair of contacts 120. Thus the sides 222 of the contact surfaces 204 closest to the opening 125 of the socket 102 may be designed in some examples to be closer to one another than the remainder of the contact surfaces 204. However, in other example terminals, the contact surfaces may be entirely parallel to one another, especially in examples where minimal interference is intended. Still further, in some examples the contact surfaces 204 of the second pair of contacts 120 may have continuous curvature similar to the contact surfaces 202 of the first pair of contacts 118. In some cases, this may help alleviate the scenario where part of the contact surface separates from the male contact.

Figure 4:
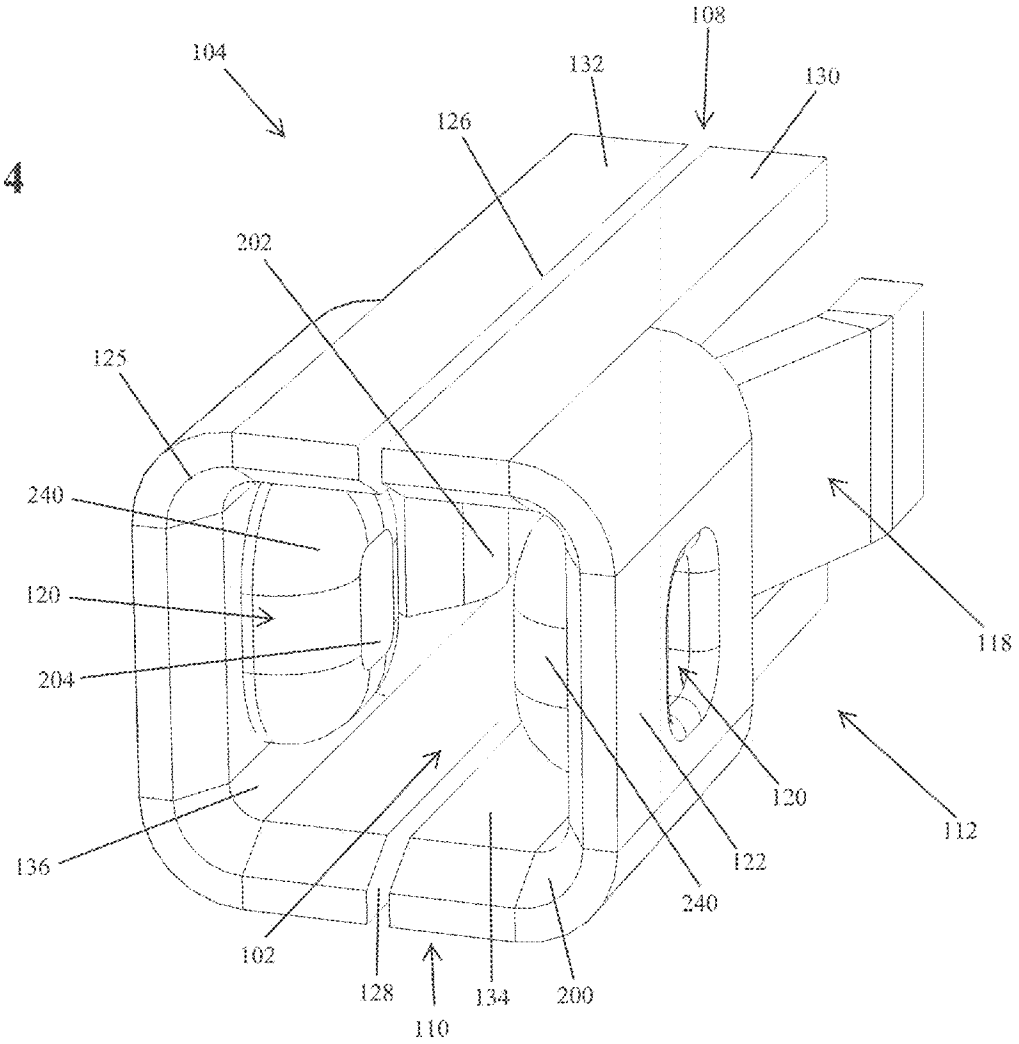
FIG. 4 is a partial perspective view of an example socket of an example terminal for an electrical connector.

FIG. 4 shows a partial close-up view of one example of the distal end 104 of the example terminal 100. More specifically, FIG. 4 provides a clear perspective view of the opening 125 of the example socket 102. Those having ordinary skill in the art will understand based on FIG. 4 how each of the second pair of contacts 120 is forced apart from one another as the male contact is inserted into the socket 102 and begins to contact front faces 240 of the second pair of contacts 120. Further, as explained above, the example socket 102 is not limited to a generally-rectangular shape and may take on a circular, elliptical, triangular, pentagonal, hexagonal, or other shape depending on the male contact with which the socket 102 is intended to mate.

Figure 5A:
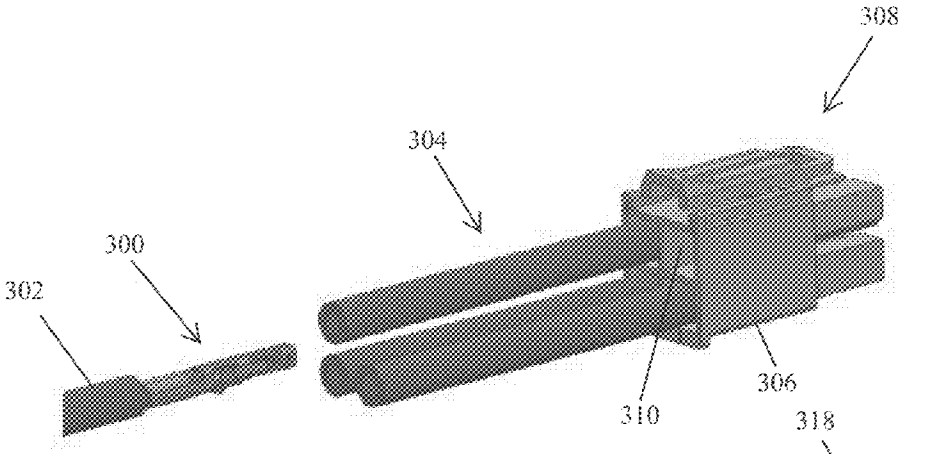
FIG. 5A is perspective view of an example terminal being inserted into an example electrical connector.

The remaining figures depict various example contexts in which the disclosed terminals may be used. Turning now to FIG. 5A, for instance, an example terminal 300 is shown to be secured to a wire 302, or at least to internal conductors of the wire 302. Also, a plurality of wires 304 is shown to be secured to a housing 306 of a first electrical connector 308. The housing 306 includes an open receptacle 310 that can receive and secure the example terminal 300.

Figure 5B:
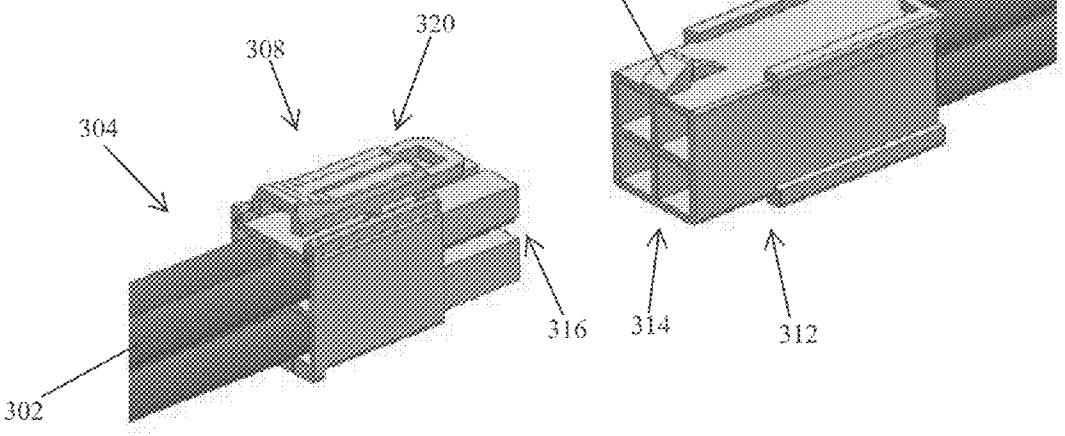
FIG. 5B is a perspective view of the example electrical connector of FIG. 5A being mated with another example electrical connector.

FIG. 5B illustrates how the first electrical connector 308 can mate with a second electrical connector 312 after the example terminal 300 is secured to the housing 306 of the first electrical connector 308. In one example, the second electrical connector 312 includes a plurality of receptacles 314 for receiving a plurality of projections 316 of the first electrical connector 308. Although not visible in FIG. 5B, at least one male terminal may be secured within each of the plurality of receptacles 314 of the second electrical connector 312. Each male terminal may be electrically connected to conductors within a plurality of wires 318 secured to the second electrical connector 312. Further, those male terminals of the second electrical connector 312 are configured to mate with the female terminals (not visible) located within the first electrical connector 308. In some examples, the electrical connectors 308, 312 include interlocking features 320 that help secure the electrical connectors 308, 312 to one another. Thus the example terminals of the present disclosure may be utilized in wire-to-wire connections.

Figure 6A:
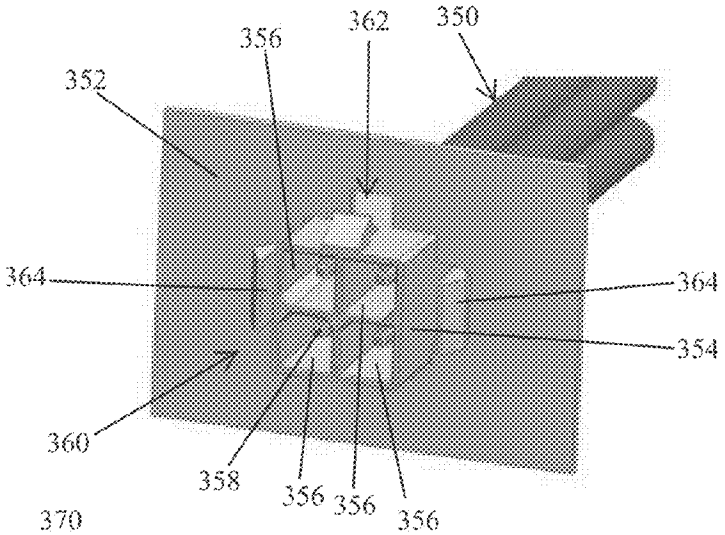
FIG. 6A is a perspective view of an example panel within which an example terminal disposed in an example electrical connector may be secured.

FIG. 6A shows an example of a plurality of wires 350 connected to a panel 352. In this example, the plurality of wires 350 is secured to a housing 354 that is inserted through the panel 352. In this example, the housing 354 is selectively retained by the panel 352. The example housing 354 includes a plurality of receptacles 356, each of which may contain an example terminal 358 that is electrically coupled to conductors within the plurality of wires 350 in some examples. The housing 354 may generally be considered to be part of an electrical connector 360. In addition, the example panel 352 includes an opening 362 through which the housing 354 of the electrical connector 360 extends. The housing 354 in some examples includes clips 364 that secure the housing 354 to the opening 362 of the panel 352.

Figure 6B:
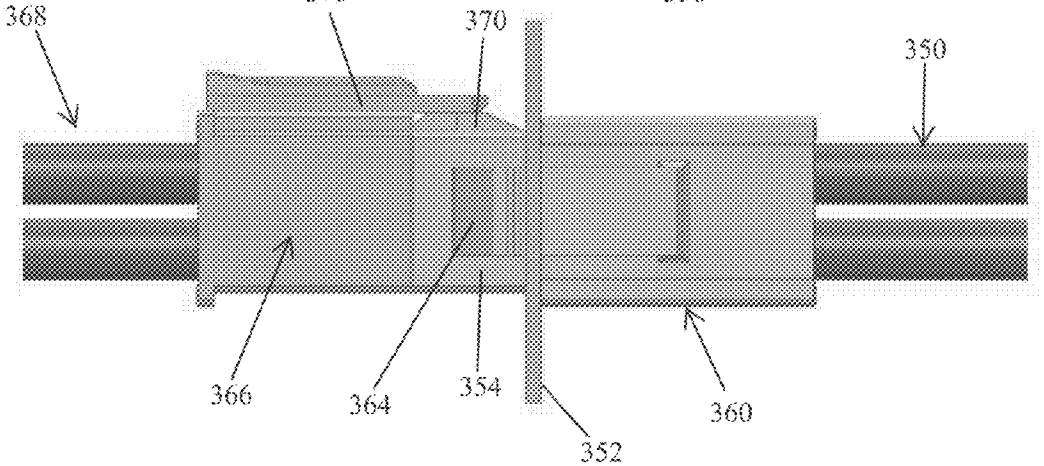
FIG. 6B is a partial side view of the example electrical connector and the example panel of FIG. 6A.

Furthermore, FIG. 6B shows how the example electrical connector 360 of FIG. 6A mates with another electrical connector 366 that is coupled to a plurality of wires 368. Similar to the electrical connectors 308, 312 discussed above, the electrical connectors 360, 366 likewise include one or more interlocking features 370 in some examples.

Figure 7:
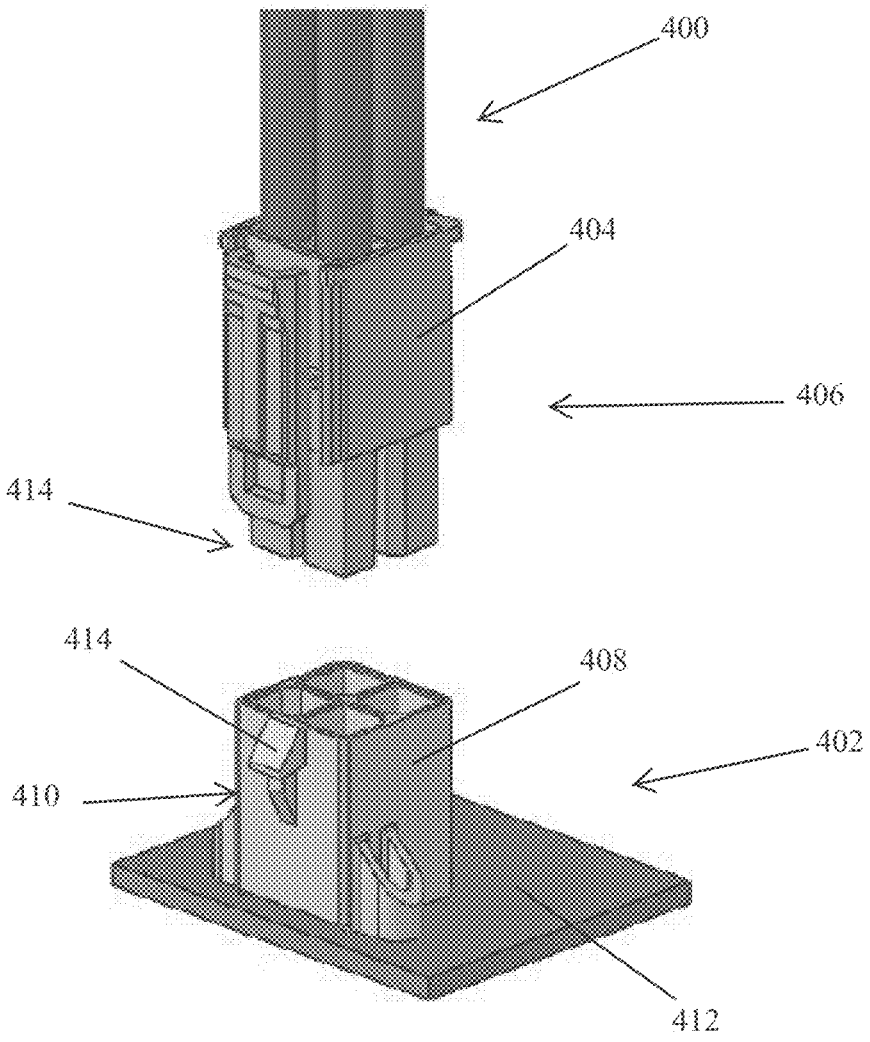
FIG. 7 is a perspective view of an example electrical connector being secured to a printed circuit board (PCB) header.

FIG. 7 shows still another example context, wherein the example terminals of the present disclosure may be utilized to secure a plurality of wires 400 to a vertical PCB header 402. In one example, the plurality of wires 400 is secured within a housing 404 of an electrical connector 406 as shown. Internal conductors of the wires 400 may be electrically coupled to terminals such as the example terminals disclosed above. Further, a housing 408 of an electrical connector 410 is coupled physically and electrically to a PCB 412 in this example. Alternatively, it should be understood that female terminals, such as those disclosed in the various examples above, may be disposed in the housing 408 of the electrical connector 410 coupled to the PCB 412, as opposed to being disposed in the housing 404 of the electrical connector 406. Further, the electrical connectors 406, 410 shown in the example of FIG. 7 include at least one interlocking feature 414 similar to other example electrical connectors.

Figure 8:
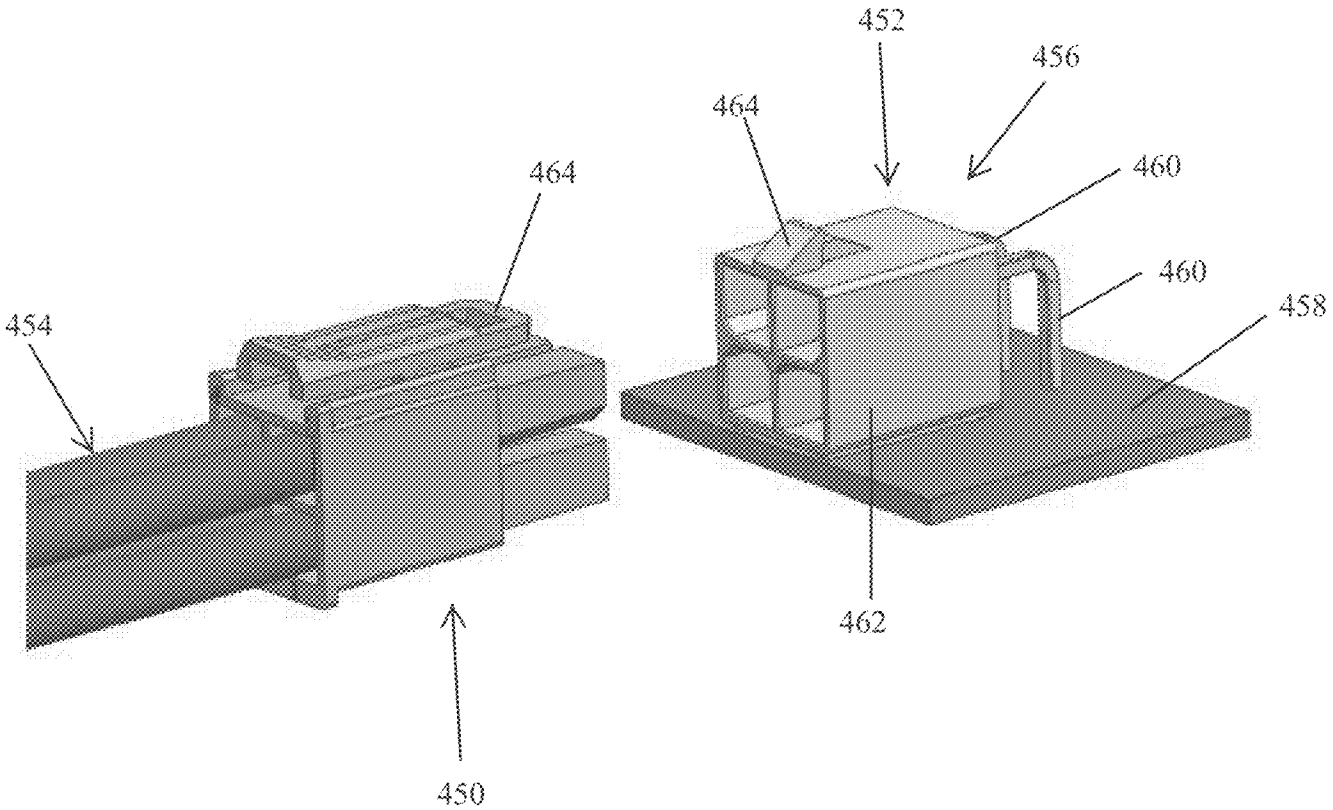
FIG. 8 is a perspective view of an example electrical connector being secured to a right-angle PCB header.

In still another example shown in FIG. 8, female terminals such as those disclosed above may be utilized in a first electrical connector 450 or a second electrical connector 452. In this example, the first electrical connector 450 is shown to be coupled to a plurality of wires 454, while the second electrical connector 452 is shown as part of an example right-angle PCB header 456. The right-angle PCB header 456 is in turn coupled to a PCB 458. The example right-angle PCB header 456 includes male contacts 460 that extend into a housing 462 of the second electrical connector 452. The electrical connectors 450, 452 of FIG. 8 may include features similar in some respects to the other electrical connectors discussed above, such as interlocking features 464, for instance.

Although certain example terminals have been described herein, the scope of coverage of this patent is not limited thereto. On the contrary, this patent covers all methods, apparatus, and articles of manufacture fairly falling within the scope of the appended claims either literally or under the doctrine of equivalents. Further, even though the appended claims make reference to a male terminal, the appended claims do not require a male terminal. "Male terminal" is recited in the claims merely for frame of reference and to provide context.

We claim:

1. A terminal for an electrical connector, the terminal comprising:

a left sidewall, a right sidewall opposing the left sidewall, a bottom wall, and a top wall opposing the bottom wall, wherein the left sidewall, the right sidewall, the bottom wall, and the top wall form a socket with an opening for receiving a male terminal, the socket being disposed along a distal end of the terminal;

a first pair of contacts, wherein a first one of the first pair of contacts is disposed along the left sidewall and provides a first contact surface along the left sidewall and a second one of the first pair of contacts is disposed along the right sidewall and provides a second contact surface along the right sidewall; and a second pair of contacts, wherein a first one of the second pair of contacts is disposed along the left sidewall and provides a third contact surface along the left sidewall and a second one of the second pair of contacts is disposed the right sidewall and provides a fourth contact surface is disposed along the right sidewall;

wherein each of the first, second, third, and fourth contact surfaces are configured to apply a normal force to a male terminal that is receivable by the socket, with the normal force to be applied by each of the first, second, third, and fourth contact surfaces being substantially the same, and wherein the first pair of contacts is positioned in front of the second pair of contacts in an insertion direction of the male terminal.

2. A terminal of claim 1, further comprising at least one crimping member opposite the distal end, the crimping member for securing at least one of an insulation of a wire or an internal conductor of the wire.

3. A terminal of claim 1, wherein a first slit in the top wall separates a left portion and a right portion of the top wall, wherein a second slit in the bottom wall separates a left portion and a right portion of the bottom wall, the first and second slits permitting the left sidewall, the left portion of the top wall, and the left portion of the bottom wall to resiliently flex away from the right sidewall, the right portion of the top wall, and the right portion of the bottom wall.

4. A terminal of claim 1, further comprising a pair of positioning tabs disposed along the left and right sidewalls, the pair of positioning tabs being resilient and projecting outwards from the left and right sidewalls, wherein the pair of positioning tabs are configured to snap into corresponding recesses of the electrical connector to secure the terminal within the electrical connector.

5. A terminal of claim 1, further comprising a locating feature disposed along the bottom wall, the locating feature configured to contact a shoulder in the electrical connector to locate the terminal within the electrical connector.

6. A terminal of claim 1, wherein at least some parts of the first and second pairs of contacts project into the socket, the at least some parts of the first and second pairs of contacts configured to be displaced when the male terminal is inserted into the socket.

7. A terminal of claim 1, wherein the normal force applied by each of the first, second, third, and fourth contacts surfaces is between approximately 200 to 400 grams.

8. A terminal of claim 1, wherein the second pair of contacts are disposed along portions of the left and right sidewalls that extend between the top wall and the bottom wall, the second pair of contacts being adjacent to the opening of the socket.

9. A terminal of claim 1, wherein the first, second, third, and fourth contact surfaces have surface areas that are substantially the same.

10. A female terminal for an electrical connector, the female terminal configured to receive a male terminal so as to electrically couple the male and female terminals, the female terminal comprising:

a socket with an opening for receiving the male terminal, the socket being generally quadrilateral and defined by a left sidewall, a right sidewall, a top wall, and a bottom wall, wherein a first slit in the top wall separates a left portion and a right portion of the top wall, wherein a second slit in the bottom wall separates a left portion and a right portion of the bottom wall, the first and second slits permitting the left sidewall, the left portion of the top wall, and the left portion of the bottom wall to flex away from the right sidewall, the right portion of the top wall, and the right portion of the bottom wall;

a first pair of contacts, wherein a first one of the first pair of contacts is disposed along the left sidewall and provides a first contact surface along the left sidewall and a second one of the first pair of contacts is disposed along the right sidewall and provides a second contact surface along the right sidewall; and a second pair of contacts, wherein a first one of the second pair of contacts is disposed along the left sidewall and provides a third contact surface along the left sidewall and a second one of the second pair of contacts is disposed the right sidewall and provides a fourth contact surface is disposed along the right sidewall;

wherein each of the first, second, third, and fourth contact surfaces are configured to apply a normal force to the male terminal that is receivable by the socket, with the normal force applied by each of the first, second, third, and fourth contact surfaces being substantially the same, and wherein the first pair of contacts is positioned in front of the second pair of contacts in an insertion direction of the male terminal.

11. A terminal of claim 10, further comprising at least one crimping member configured to secure a wire to the terminal.

12. A terminal of claim 10, further comprising a pair of positioning tabs disposed along the left and right sidewalls, the pair of positioning tabs being resilient and projecting outwards from the left and right sidewalls, wherein the pair of positioning tabs are configured to snap into corresponding recesses of the electrical connector to secure the terminal within the electrical connector.

13. A terminal of claim 11, wherein at least some parts of the first and second pairs of contacts project into the socket, the at least some parts of the first and second pairs of contacts configured to be displaced when the male terminal is inserted into the socket.

14. A terminal of claim 11, wherein the second pair of contacts are disposed along portions of the left and right sidewalls that extend between the top wall and the bottom wall, the second pair of contacts being adjacent to the opening of the socket.

* * * * *